US010390577B2

(12) United States Patent
Hormay et al.

(10) Patent No.: US 10,390,577 B2
(45) Date of Patent: Aug. 27, 2019

(54) ROBUST ARTIFICIAL FOLIAGE

(71) Applicant: Disney Enterprises, Inc., Burbank, CA (US)

(72) Inventors: Zsolt Hormay, Pasadena, CA (US); Steven Porter, Glendale, CA (US)

(73) Assignee: Disney Enterprises, Inc., Burbank, CA (US)

( * ) Notice: Subject to any disclaimer, the term of this patent is extended or adjusted under 35 U.S.C. 154(b) by 827 days.

(21) Appl. No.: 14/596,164

(22) Filed: Jan. 13, 2015

(65) Prior Publication Data

US 2016/0198785 A1 Jul. 14, 2016

(51) Int. Cl.
*A41G 1/00* (2006.01)

(52) U.S. Cl.
CPC ..... *A41G 1/00* (2013.01)

(58) Field of Classification Search
None
See application file for complete search history.

(56) References Cited

PUBLICATIONS

Dip A Flower. Midlife Crisis. Mar. 25, 2013. http://midlifecrisishawaii.com/memories/do-you-remember-dip-a-flower.*
Craft Wire. 2014. http://www.craftwire.org.*
Water Jet Cutting. Jan. 22, 2013. http://waterjets.org.*

* cited by examiner

*Primary Examiner* — D. Lawrence Tarazano
*Assistant Examiner* — Stephanie A Cox
(74) *Attorney, Agent, or Firm* — Patent Ingenuity, P.C.; Samuel K. Simpson

(57) ABSTRACT

An apparatus comprises a wire mesh that is shaped according to an artificial foliage pattern. The wire mesh is coated with a coating to match a characteristic of the artificial foliage pattern. The coating fills in spaces between the wire mesh to produce a translucent structure in the spaces that filters light. The mesh size, mesh materials, and the type of coating, e.g., type of paint, are selected so that the coating fills in the spaces to produce a translucent structure that is thin yet strong. The thin translucent structure allows light to filter through in a natural manner. A process performs the shaping and coating of the wire mesh.

20 Claims, 4 Drawing Sheets

ROBUST ARTIFICIAL FOLIAGE

BACKGROUND

1. Field

This disclosure generally relates to the field of foliage. More particularly, the disclosure relates to artificial foliage.

2. General Background

Artificial foliage is used in a variety of environments, e.g., theme parks, commercial properties, highways, etc. to enhance the visual appearance of the environment without incurring the much more significant expense associated with real foliage. The regular maintenance costs associated with real foliage, e.g., watering, trimming, etc., can be avoided by using artificial foliage.

To be effective, artificial foliage needs to visually recreate the experience of real foliage while also being low maintenance and environmentally robust. Typical artificial foliage is fabricated from plastic, silk, nylon, paper, or other materials that are adapted for indoor use in controlled environments. Such artificial foliage is difficult to use in outdoor environments. For example, plastics fade and break down in sunlight, fragile materials tear and break as a result of inclement weather, etc. Further, the materials used for such artificial foliage are typically difficult to clean in an efficient manner such as with power sprayers or power washers.

Therefore, current artificial foliage products do not maintain their intended visual appearance for extended periods of time. A robust artificial foliage configuration is needed to provide artificial foliage that is visually convincing and durable.

SUMMARY

An apparatus comprises a wire mesh that is shaped according to an artificial foliage pattern. The wire mesh is coated with a coating to match a characteristic of the artificial foliage pattern. The coating fills in spaces between the wire mesh to produce a translucent structure in the spaces that filters light. The mesh size, mesh materials, and the type of coating, e.g., type of paint, are selected so that the coating fills in the spaces to produce a translucent structure that is thin yet strong. The thin translucent structure allows light to filter through in a natural manner. A process performs the shaping and coating of the wire mesh.

BRIEF DESCRIPTION OF THE DRAWINGS

The above-mentioned features of the present disclosure will become more apparent with reference to the following description taken in conjunction with the accompanying drawings wherein like reference numerals denote like elements and in which.

DETAILED DESCRIPTION

An artificial foliage apparatus is used to provide artificial foliage that is visually convincing and durable. A translucent coating is applied to the artificial foliage apparatus to produce a translucent effect. An opaque coating can be applied to the artificial foliage apparatus instead of or in addition to the translucent coating. The artificial foliage apparatus with the coating has a similar appearance to that of conventional artificial foliage that is fabricated from paper, cloth, etc., but is more durable than such conventional artificial foliage. The translucent coating helps maintain the visual appearance of the artificial foliage apparatus for an extended period of time. The coated artificial foliage apparatus is storm resistant, wind resistance, and cleanable in theme park environments, recreational environments, commercial property environments, utility environments, etc.

Figure 1:
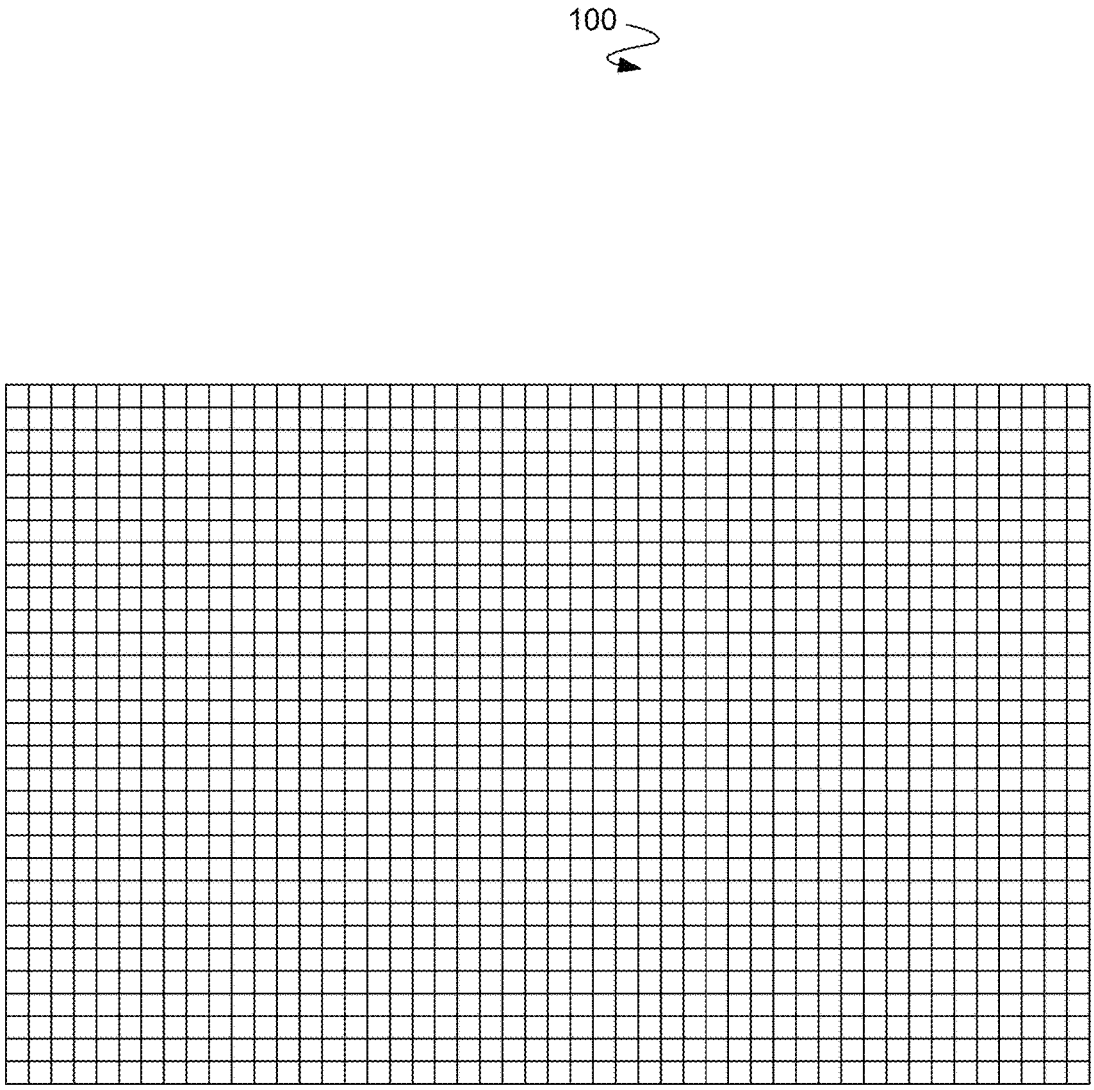
FIG. 1 illustrates a structural mesh.

FIG. 1 illustrates a structural mesh 100. The structural mesh 100 comprises a mesh such as a stainless steel wire mesh. Materials other than stainless steel may be used so long as the material can be formed into a mesh with sufficient memory to form foliage and retain its shape, and is resistant to environmental exposure in the particular application. The structural mesh 100 has overlapping wires and open spaces between the overlapping wires. The structural mesh 100 comprises uncoated or coated mesh where the coating is selected to provide desired environmental resistance and allows subsequent coatings, to be applied to the structural mesh 100. Similarly, some applications may use mechanical or chemical surface treatments to condition the surface of the structural mesh 100 for subsequent processing such as to increase or decrease the surface roughness or wettability.

Figure 2A:
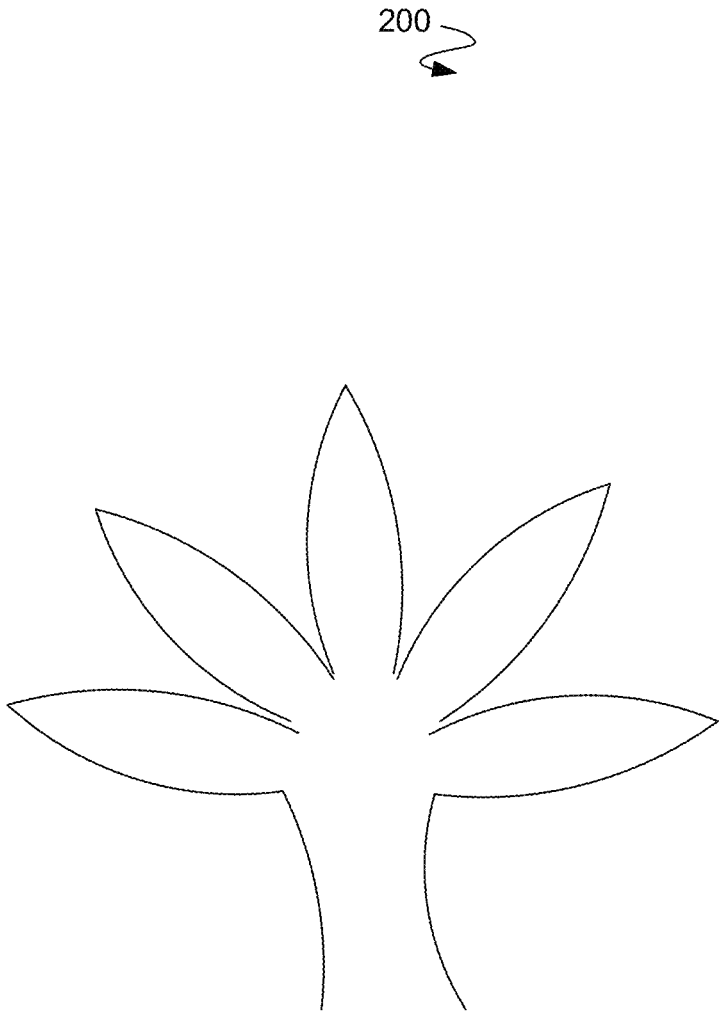
FIG. 2A illustrates an artificial foliage pattern.
Figure 2B:
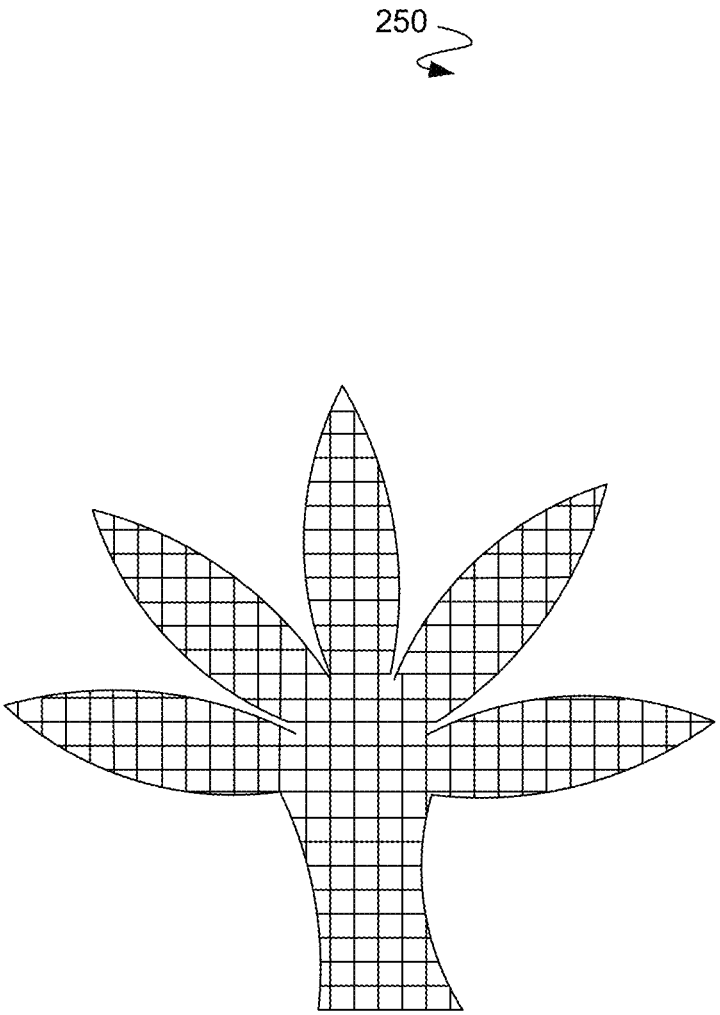
FIG. 2B illustrates an example of an artificial foliage apparatus that is shaped according to the artificial foliage pattern illustrated in FIG. 2A.

The structural mesh 100 is shaped according to particular artificial foliage patterns. FIG. 2A illustrates an artificial foliage pattern 200. The artificial foliage pattern 200 is illustrated as a plurality of leaves. FIG. 2B illustrates an example of an artificial foliage apparatus 250 that is shaped according to a pattern such as the artificial foliage pattern 200 illustrated in FIG. 2A. The artificial foliage apparatus 250 is a leaf shape, but in a typical application a variety of leaf shapes might be used, as well as flower petals, bark, and the like.

The structural mesh 100 is shaped through water jet cutting the structural mesh 100 to form the artificial foliage apparatus 250 that is shaped to resemble the artificial foliage pattern 200. Water jet cutting is convenient where available, but shaping by laser cutting, die cutting, mechanical snippers and the like are suitable in particular applications. These cutting techniques may be used individually or in combination to achieve a desired shape.

A coating is applied to the artificial foliage apparatus 250 to provide the artificial foliage apparatus 250 with the appearance of the artificial foliage pattern 200. A liquid can be sprayed, dipped, or squeegee applied, to form a coating that fills in the open spaces in the artificial foliage apparatus 250. For instance, a thin translucent or opaque film of paint such as automotive urethane paint, paint that has colorfast pigment, paint that has UV resistant pigment, paint that has chemical resistant pigment, paint that has fire resistant pigment, or paint with another durable finish can be used to paint the artificial foliage apparatus 250 the same color as the artificial foliage pattern 200 and fill in any open spaces. Therefore, the artificial foliage apparatus 250 has the appearance of the artificial foliage pattern 200. The applied liquid forms a robust coating on the artificial foliage apparatus 250 that is durable in particular environments, e.g., environments that are prone to inclement weather. The resulting artificial foliage can be bent before or after painting to have the natural appearance of real organic foliage since the artificial foliage apparatus 250 is bendable and can maintain its shape.

The resulting artificial foliage apparatus 250 is inexpensive and visually convincing at as close as five to ten feet. The resulting artificial foliage apparatus 250 can be attached to stainless steel tubing, rope or wire that will appear as branches, stems, and twigs to build complete plants and hedges of arbitrary size and coloring. Since the entire structure for such artificial plants and hedges is formed from weather resistant materials and/or materials that are coated with a weather resistant liquid spray, the entire structure can be easily cleaned and maintained.

In another implementation, a process is used to laminate fiberglass matt to one side or both sides of the artificial foliage apparatus 250. The fiberglass matt both reinforces and hides the screen texture of the artificial foliage apparatus 250. Urethane is used to adhere the fiberglass matt to the artificial foliage apparatus 250. The fiberglass matt helps the artificial foliage apparatus 250 appear more realistic in environments in which the artificial foliage apparatus 250 may often be viewed close up. The artificial foliage apparatus 250 may be laminated with the fiberglass matt during the same process, i.e., with the same machine, that is used to coat the artificial foliage apparatus 250 or through an independent process, i.e., with a different machine.

Figure 3:
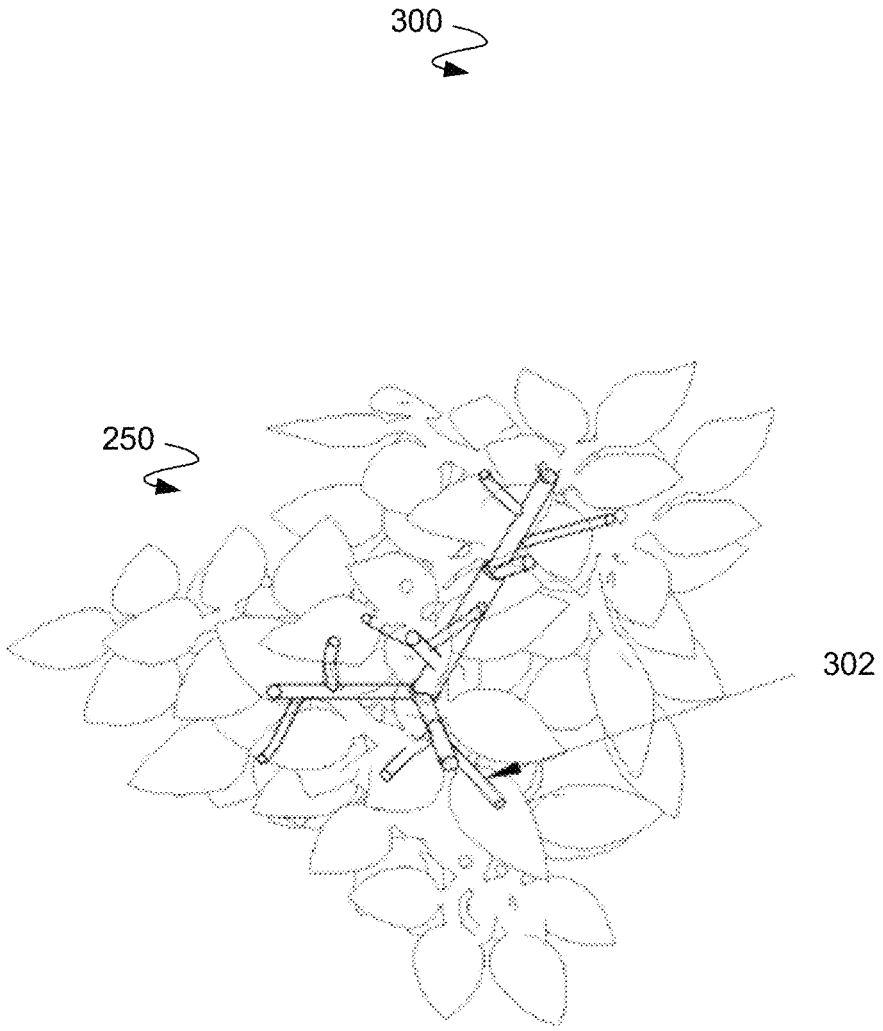
FIG. 3 illustrates an artificial foliage assembly.

FIG. 3 illustrates an artificial foliage assembly 300. The artificial foliage assembly 300 has a support structure 302 that provides support for one or more artificial foliage apparatuses 250. As an example, the support structure 302 comprises a stainless steel trunk with stainless steel limbs to which the one or more artificial foliage apparatuses 250 are operably attached. A variety of materials such as stainless steel tubing and stainless steel rods can be used for the support structure 302. Further, various connecting mechanisms such as wires, screws, bolts, adhesives, etc., can be used to connect the support structure 302 to the artificial foliage apparatuses 250 to form the artificial foliage assembly 300. The support structure 302 can be painted to resemble a real trunk or limb. The same coating that is used for painting the artificial foliage apparatus 250 can be used to paint the support structure 302. The support structure 302 can also be a connecting mechanism such as a wire that is used to connect the one or more artificial foliage apparatuses 250.

The artificial foliage assembly 300 can also be used with stainless steel wool, glass fiber, or glass matting that is painted to provide artificial plant structures with a mossy appearance. A stainless steel web with an environmentally robust coating such as outdoor automotive urethane paint or other durable finish is used to provide a natural mossy appearance for the artificial plant structure.

The described artificial foliage configurations can be used for significant periods of time while retaining their originally planned visual appearances with a low amount of maintenance. The artificial foliage configurations are storm resistant and cleanable in public park environments, theme park environments, highway environments, commercial property environments, utility installations, etc.

It is understood that the apparatuses and processes described herein may also be applied in other types of apparatuses and processes. Those skilled in the art will appreciate that the various adaptations and modifications of the aspects of the apparatuses and processes described herein may be configured without departing from the scope and spirit of the present apparatuses and processes. Therefore, it is to be understood that, within the scope of the appended claims, the present apparatuses and processes may be practiced other than as specifically described herein.

We claim:

1. An apparatus comprising:

a wire mesh that is shaped according to an artificial foliage pattern and is coated with a coating to match a characteristic of the artificial foliage pattern, the coating filling in spaces between the wire mesh to produce a translucent structure in the spaces that filters light.

2. The apparatus of claim 1, wherein the characteristic is a color of the artificial foliage pattern.

3. The apparatus of claim 1, wherein the coating is weather resistant.

4. The apparatus of claim 1, wherein the wire mesh has overlapping wires and spaces.

5. The apparatus of claim 4, wherein the coating fills in the spaces.

6. The apparatus of claim 1, wherein the wire mesh is composed of stainless steel.

7. The apparatus of claim 1, wherein the wire mesh is shaped with a water jet cutter.

8. The apparatus of claim 1, wherein the wire mesh is adhered to a support structure.

9. The apparatus of claim 8, wherein the support structure is composed of stainless steel.

10. The apparatus of claim 1, wherein the wire mesh is bendable.

11. A method comprising:

shaping a wire mesh according to an artificial foliage pattern; and coating the wire mesh with a coating to match a characteristic of the artificial foliage pattern, the coating filling in spaces between the wire mesh to produce a translucent structure in the spaces that filters light.

12. The method of claim 11, wherein the characteristic is a color of the artificial foliage pattern.

13. The method of claim 11, wherein the coating is weather resistant.

14. The method of claim 11, wherein the wire mesh has overlapping wires and spaces.

15. The method of claim 14, wherein the coating fills in the spaces.

16. The method of claim 11, wherein the wire mesh is composed of stainless steel.

17. The method of claim 11, wherein the wire mesh is shaped with a water jet cutter.

18. The method of claim 11, wherein the wire mesh is adhered to a support structure.

19. The method of claim 18, wherein the support structure is composed of stainless steel.

20. The method of claim 11, wherein the wire mesh is bendable.

* * * * *